US008388063B2

(12) United States Patent
Fiore, Jr. et al.

(10) Patent No.: US 8,388,063 B2
(45) Date of Patent: Mar. 5, 2013

(54) CHILD BOOSTER SEAT AND HEIGHT-ADJUSTMENT MECHANISM THEREOF

(75) Inventors: Joseph F. Fiore, Jr., Lebanon, PA (US); Zhang Shao-Yue, Taipei (TW)

(73) Assignee: Wonderland Nurserygoods Company Limited, Central (HK)

( * ) Notice: Subject to any disclaimer, the term of this patent is extended or adjusted under 35 U.S.C. 154(b) by 379 days.

(21) Appl. No.: 12/730,735

(22) Filed: Mar. 24, 2010

(65) Prior Publication Data

US 2010/0244518 A1 Sep. 30, 2010

Related U.S. Application Data

(60) Provisional application No. 61/210,997, filed on Mar. 25, 2009.

(30) Foreign Application Priority Data

Oct. 26, 2009 (CN) ..... 2009 1 0179644

(51) Int. Cl.
*A47C 1/08* (2006.01)

(52) U.S. Cl. ..... 297/256.11; 297/250.1; 297/256.16

(58) Field of Classification Search ..... 297/256.11, 297/250.1, 256.16
See application file for complete search history.

(56) References Cited

U.S. PATENT DOCUMENTS

| | | | | |
|---|---|---|---|---|
| 1,922,418 | A * | 8/1933 | Conant | 297/357 |
| 5,407,246 | A * | 4/1995 | Meeker et al. | 297/137 |
| 5,688,211 | A * | 11/1997 | Myers | 482/66 |
| 6,000,750 | A * | 12/1999 | Rossman et al. | 297/2 |
| 6,299,247 | B1 * | 10/2001 | Meeker et al. | 297/137 |
| 7,032,970 | B1 * | 4/2006 | Kharat | 297/256.11 |
| 7,387,337 | B2 * | 6/2008 | Keegan et al. | 297/256.13 |
| 7,673,940 | B2 * | 3/2010 | Fritz et al. | 297/256.11 |
| 7,871,125 | B2 * | 1/2011 | Asbach et al. | 297/256.11 |
| 8,070,226 | B2 * | 12/2011 | Dingler et al. | 297/256.11 |
| 8,091,965 | B2 * | 1/2012 | Flannery et al. | 297/256.16 |

* cited by examiner

*Primary Examiner* — Laurie Cranmer
(74) *Attorney, Agent, or Firm* — Merchant & Gould P.C.

(57) ABSTRACT

A child booster seat includes a seat body, a seat base coupled to and vertically movable relative to the seat body, and a height-adjustment mechanism mounted between the seat body and the seat base. The height-adjustment mechanism includes a support structure mounted co-movably to the seat body and formed with a plurality of positioning holes that are vertically spaced apart. The height-adjustment mechanism further includes a latching component coupled movably to the seat base. The latching component includes a stop piece for engaging a selected one of the positioning holes to releasably lock the seat body at a desired height relative to the seat base. The height-adjustment mechanism also includes a manually operable part for moving the stop piece away from the positioning holes to release locking engagement between the seat base and the seat body.

18 Claims, 11 Drawing Sheets

CHILD BOOSTER SEAT AND HEIGHT-ADJUSTMENT MECHANISM THEREOF

CROSS-REFERENCE TO RELATED APPLICATIONS

This application claims priority to U.S. provisional application No. 61/210,997, filed on Mar. 25, 2009, and Chinese application no. 200910179644.0, filed on Oct. 26, 2009.

BACKGROUND OF THE INVENTION

1. Field of the Invention

The invention relates to a height-adjustment mechanism, and more particularly to a child booster seat and height-adjustment mechanism thereof.

2. Description of the Related Art

An example of a child booster seat is disclosed in U.S. Patent Publication No. 2008/0116723, which may allow adjustment of the child booster seat through multiple separate manual operations. For example, these steps may involve grasping a first adjusting part with one hand while extending a first support part with a second hand. These steps may also include grasping a second adjusting part with one hand while operating a second support part of the child booster seat with a second hand. These operations may be inconvenient or problematic for a user occupied with childcare or other tasks.

SUMMARY OF THE INVENTION

Therefore, an object of the present invention is to provide a height-adjustment mechanism for a child booster seat that permits operation of a latching component and extension of a seat base using a manually operable part. Accordingly, a height-adjustment mechanism for a child booster seat of the present invention is adapted for use with a seat body and a seat base coupled to and vertically movable with respect to the seat body.

A child booster seat comprises a seat body, a seat base coupled to and vertically movable relative to the seat body, and a height-adjustment mechanism mounted between the seat body and the seat base. The height-adjustment mechanism includes a support structure mounted co-movably to the seat body and formed with a plurality of positioning holes that are vertically spaced apart. The height-adjustment mechanism further includes a latching component coupled movably to the seat base. The latching component includes a stop piece for engaging a selected one of the positioning holes to releasably lock the seat body at a desired height relative to the seat base, and a manually operable part for moving the stop piece away from the positioning holes to release locking engagement between the seat base and the seat body, and a first biasing member for biasing the stop piece toward the positioning holes.

The seat base includes a bottom plate and a support structure housing that protrudes from the bottom plate. The support structure housing is formed with a receiving slot, and the support structure is slidably received within the receiving slot. The bottom plate of the seat base is formed with a through hole, and the latching component is slidably coupled to a side of the bottom plate from which the support structure housing extends. The manually operable part is accessible through the through hole.

The seat body includes a support casing formed with an accommodation space that opens downward, and the support casing 11 covers the seat base. The latching component includes a stop mounting part and a slidable coupling part that are connected to each other and that are non-planar, and the stop piece is connected to the stop mounting part above the slidable coupling part. The manually operable part is connected to the slidable coupling part.

The bottom plate of the seat base includes a fastening component. The slidable coupling part of the latching component is formed with an elongated guide hole for the fastening component to extend through and for substantially restricting the latching component to movement parallel to the bottom plate within a distance defined by the elongated guide hole.

The first biasing member is a linear spring mounted between the latching component and the bottom plate in a plane substantially parallel to the bottom plate. One of the seat body and the seat base includes a post formed with a post hole and a stop shoulder that projects into the post hole. The height-adjustment mechanism further includes a limit component mounted to the other one of the seat body and the seat base. The limit component extends through the post hole of the post, and the limit component has a restriction flange for abutting against the stop shoulder to prevent the seat base from separating from the seat body.

The limit component includes a threaded portion for mounting the limit component to the other one of the seat body and the seat base. The limit component further includes a slide rod portion extending between the threaded portion and the restriction flange for guiding vertical movement of the seat body with respect to the seat base.

The height-adjustment mechanism further includes a second biasing member mounted between the seat base and the seat body for biasing the seat base away from the seat body. The manually operable part of the latching component is configured for exerting a pulling force for pulling the seat base to move vertically relative to the seat body to adjust the height of the seat body relative to the seat base when the locking engagement between the seat base and the seat body is released.

In an embodiment, a child booster seat comprises a seat body, a seat base coupled to and vertically movable relative to the seat body, and a height-adjustment mechanism mounted between the seat body and the seat base for locking releasably the seat body at a desired height relative to the seat base. The height-adjustment mechanism is operable to release locking engagement between the seat base and the seat body and is configured for exerting a pulling force for pulling the seat base to move vertically relative to the seat body to adjust the height of the seat body relative to the seat base when the locking engagement between the seat base and the seat body is released.

Accordingly, a child booster seat and height-adjustment mechanism of this invention may include several advantages. By engaging the stop piece of the latching component with the positioning holes of the support structure, the seat body can be releasably locked to the seat base at a desired height. The manually operable part may be pulled in a first direction to release locking engagement between the seat body and the seat base and pulled in a second direction to adjust the height of the seat body relative to the seat base. The manually operable part may then be released to allow the first biasing member to move the stop piece of the latching component to engage the positioning holes of the support structure at a selected height.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
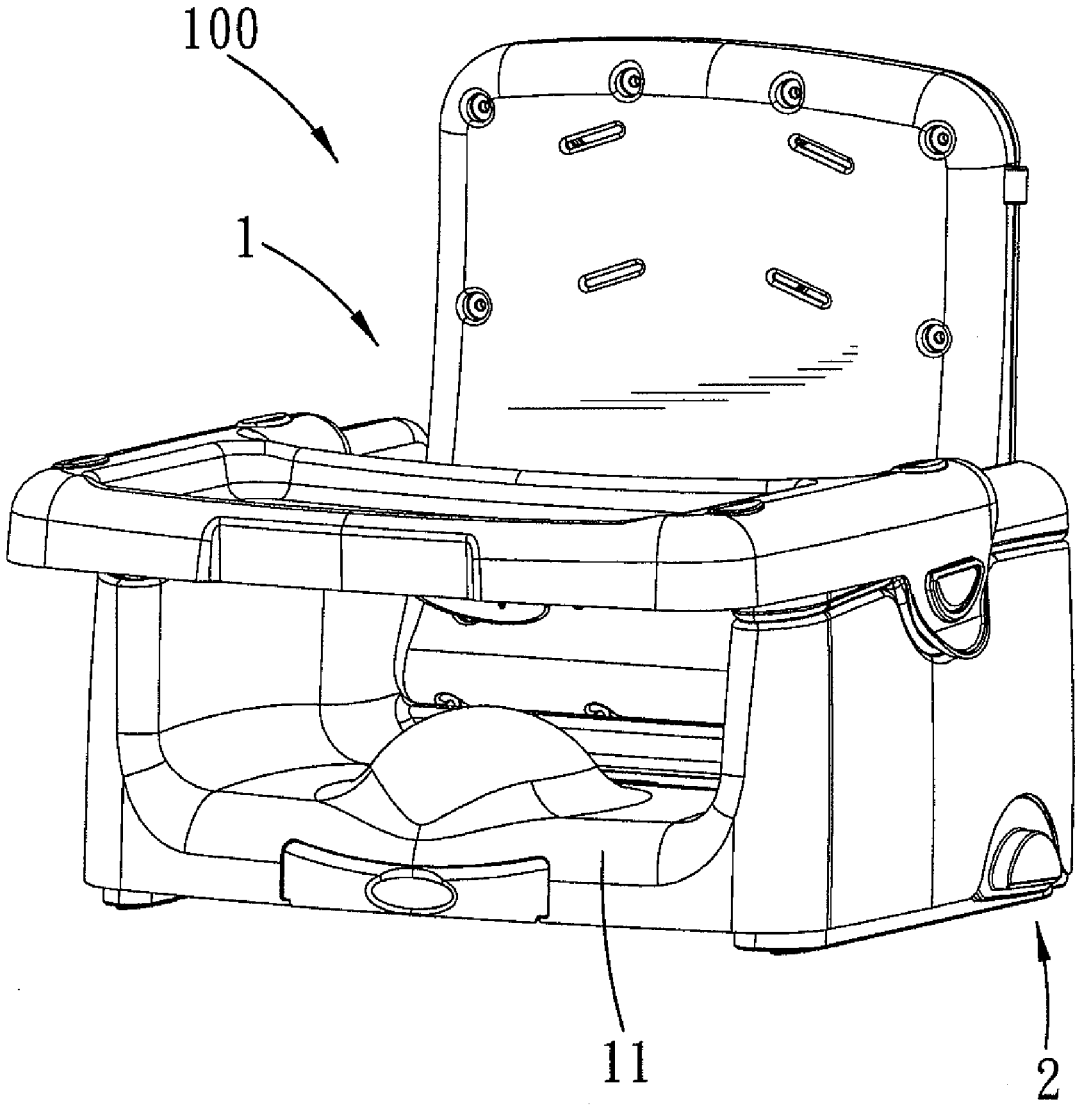
FIG. 1 is a perspective view of a child booster seat with a height-adjustment mechanism according to the preferred embodiment.

The present invention according to the preferred embodiment and its variations are presented in the following detailed description with respect to the accompanying figures, and like elements are denoted by the same reference numerals throughout the disclosure. The figures are used as references, and should not be construed to limit or restrict the claimed subject matter of the present invention.

Figure 2:
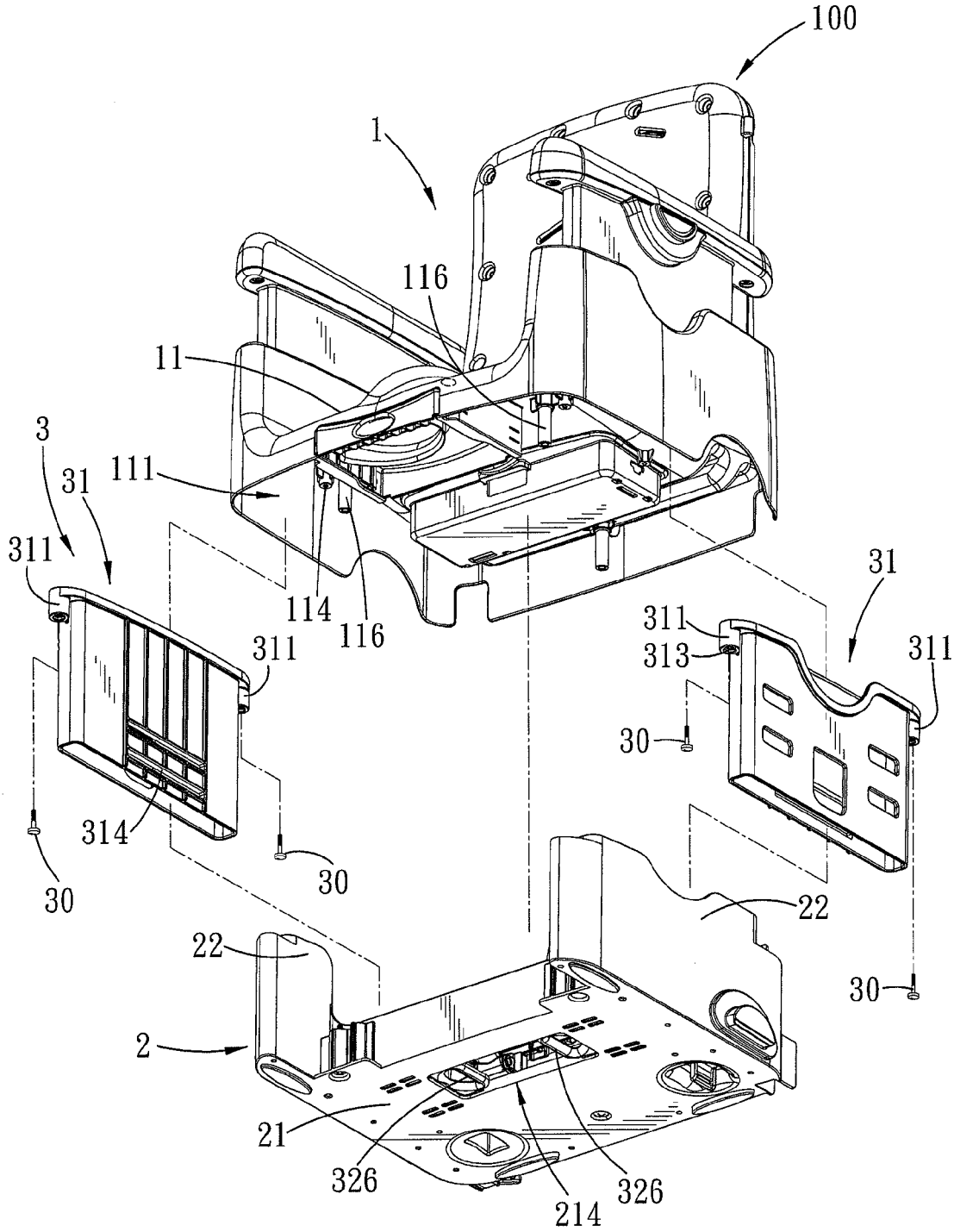
FIG. 2 is an exploded perspective view of a seat body, a support structure, and a seat base, according to the preferred embodiment.
Figure 3:
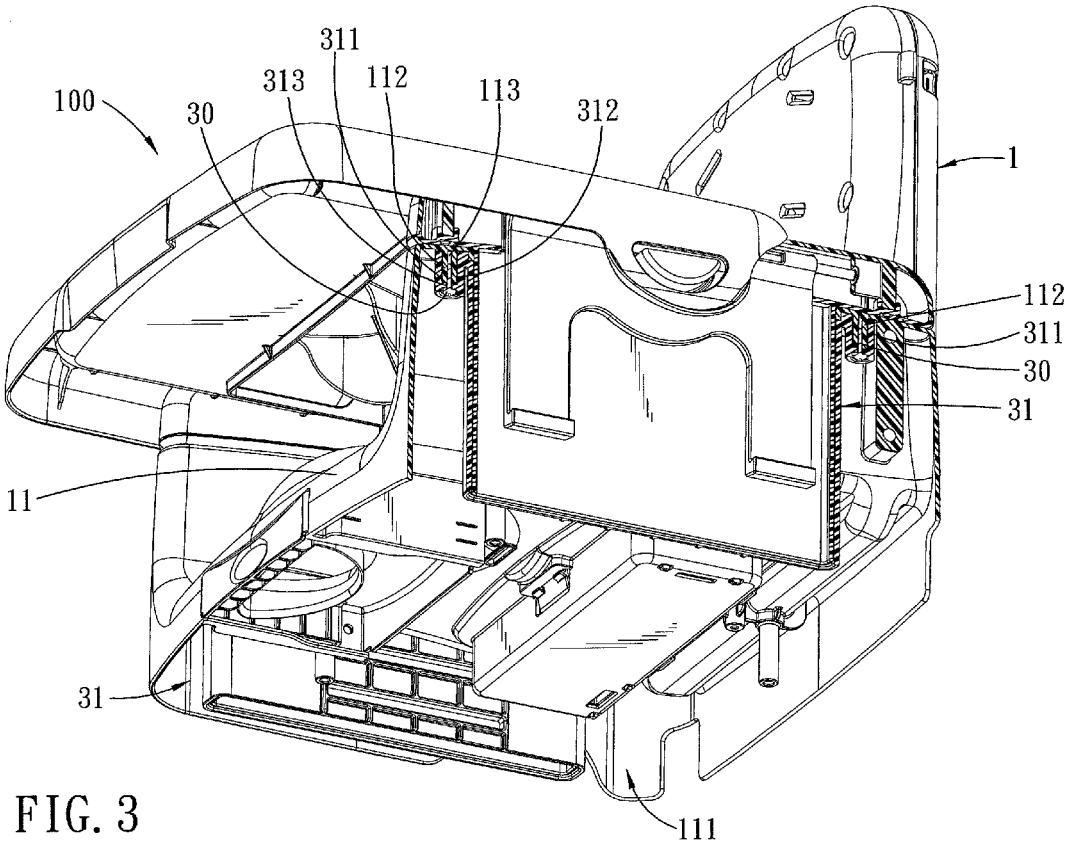
FIG. 3 is a partly sectional view of a support structure mounted co-movably to a seat body, according to the preferred embodiment.
Figure 4:
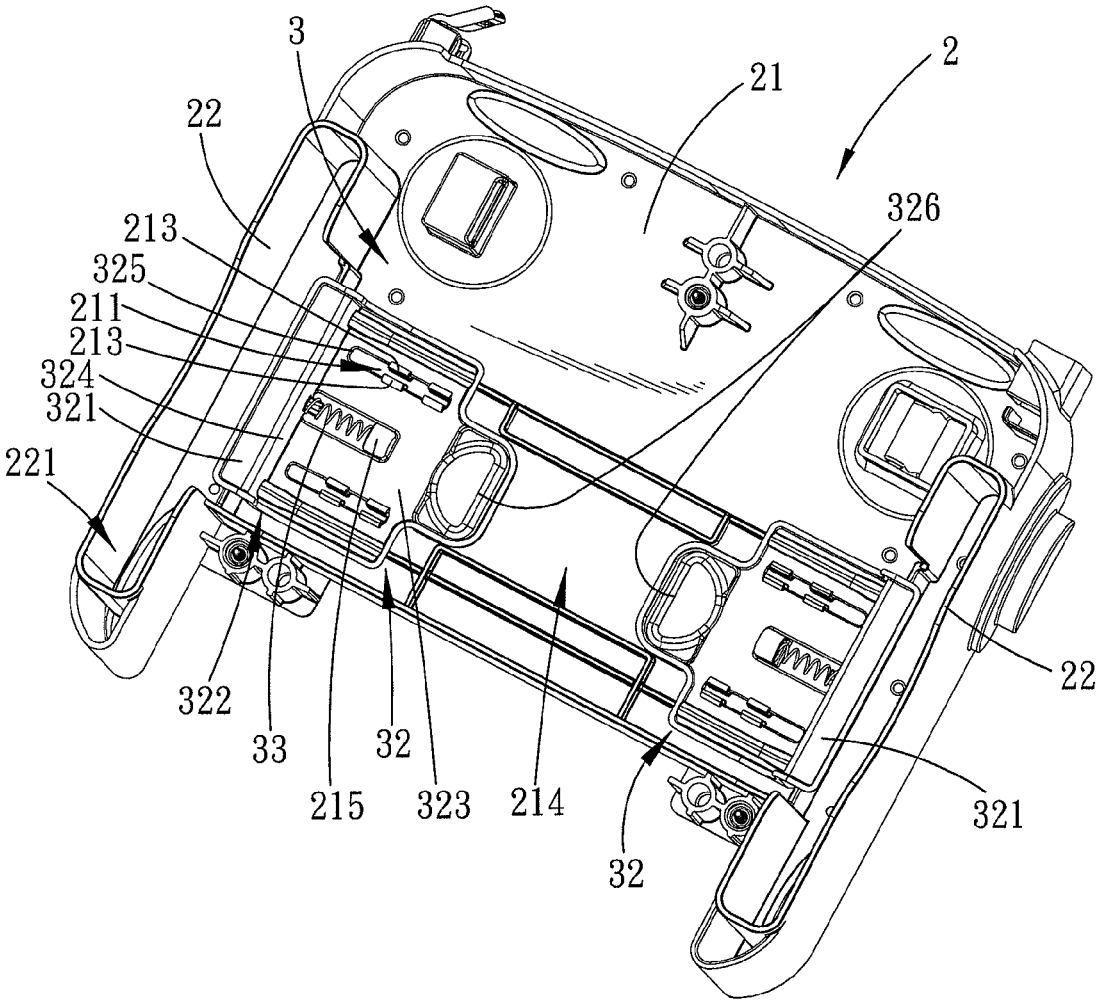
FIG. 4 is a perspective view of the latching component coupled movably to the seat base, according to the preferred embodiment.
Figure 5:
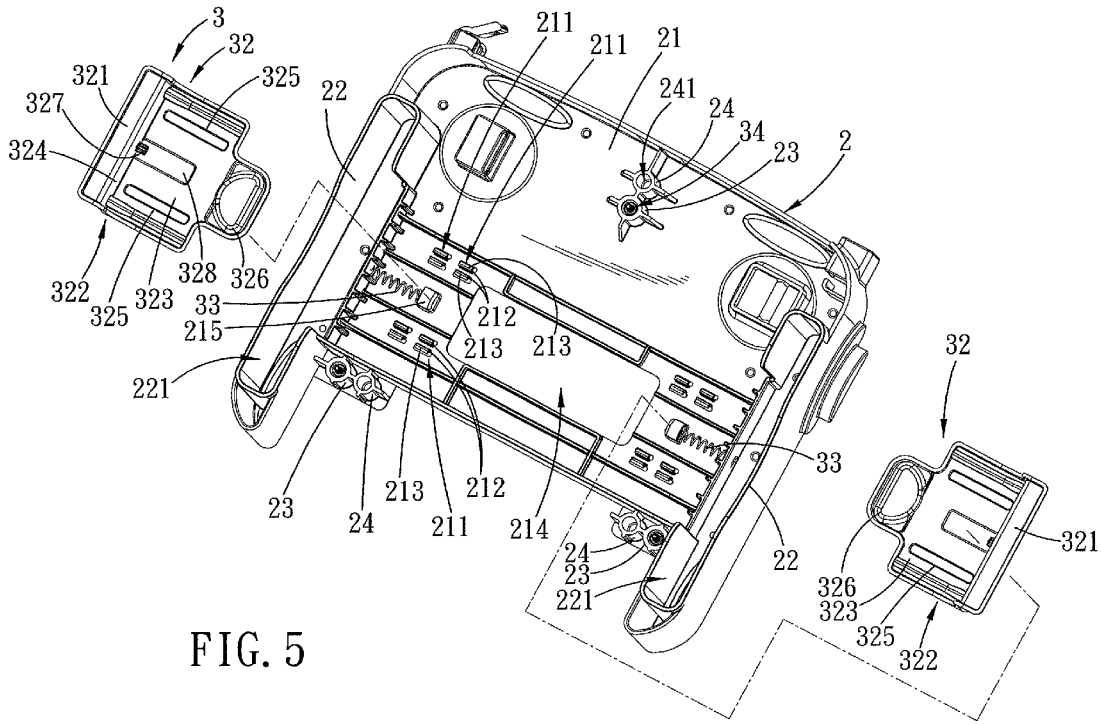
FIG. 5 is an exploded perspective view of the latching component coupled movably to the seat base, according to the preferred embodiment.
Figure 6:
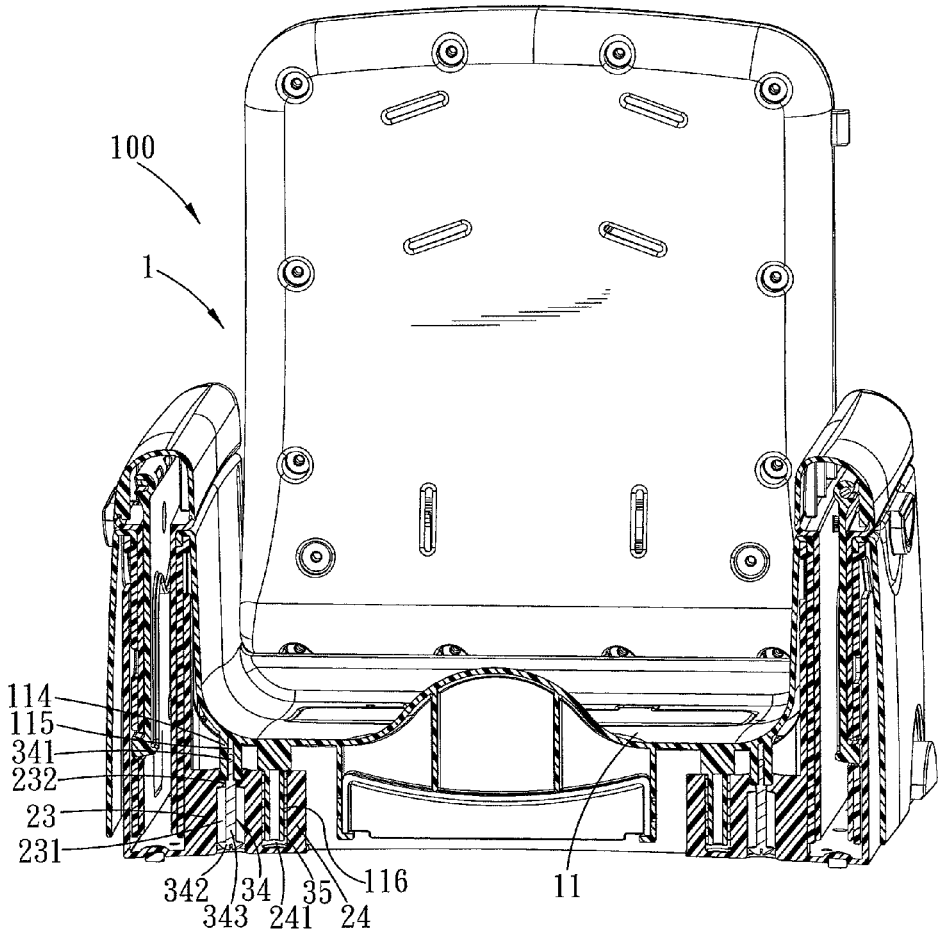
FIG. 6 is a schematic sectional view of a limit component and a second biasing member, according to the preferred embodiment.

FIGS. 1 to 10 illustrate the preferred embodiment of the child booster seat 100 and various parts of the height-adjustment mechanism 3. FIGS. 1 to 3 illustrate a seat body 1 and a pair of co-movably mounted support structures 31. FIGS. 4, 5, and 7 to 11 illustrate a seat base 2, latching components 32, and adjustment of the height of the seat body 1 above the seat base 2. FIG. 6 illustrates a limit component 34 and a second biasing member 35.

As shown in FIGS. 1 and 2, the child booster seat 100 includes the seat body 1 and the seat base 2 coupled to and vertically movable relative to the seat body 1. The seat body 1 includes a support casing 11 with an accommodation space 111 that opens downward. The support casing covers the top of the seat base 2. The seat base 2 includes a bottom plate 21 formed with a through hole 214. A pair of support structure housings 22 extend upward from the left and right lateral sides of the bottom plate 21. By moving the seat base 2 vertically with respect to the seat body 1, the height of the seat body 1 may be adjusted above a supporting surface, such as part of a chair.

The child booster seat 100 includes a height-adjustment mechanism 3 mounted between the seat body 1 and the seat base 2. The height-adjustment mechanism 3 includes the support structures 31, the latching components 32, first biasing members 33, limit components 34, and second biasing members 35. The operation of the components of the height-adjustment mechanism 3 is described in greater detail below with respect to FIGS. 2 to 10.

As shown in FIGS. 2 and 3, each of the support structures 31 is mounted co-movably to the seat body 1 within the support casing 11. The support structure 31 supports the seat body 1 above the seat base 2. The support structure 31 is formed with an elongated slot, an inner surface that faces an interior of the child booster seat 100, and an outer surface that faces an exterior of the child booster seat 100.

Each support structure 31 includes a pair of mounting sleeves 311 located at both ends of an upper opening of the elongated slot. Each of the mounting sleeves 311 includes a sleeve channel 312 that opens upward. The sleeve channel 312 receives a mounting piece 112 that is fixed to the seat body 1 and that extends downward. Each of the mounting sleeves 311 also includes a downward opening sleeve orifice 313. Each of a plurality of fasteners 30 is extended through the sleeve orifice 313 of a corresponding mounting sleeve 311 and screwed into a threaded channel 113 of a corresponding mounting piece 112 to fix the support structure 31 to the seat body 1.

Each support structure 31 further includes a plurality of positioning holes 314 that are vertically spaced apart and that may each be engaged with a stop piece 321 of a corresponding latching component 32 to adjust the height of the seat body 1 above the seat base 2 (see FIGS. 7 to 10). As illustrated, each support structure 31 includes upper and lower positioning holes 314. Additional positioning holes 314 may be used to removably fix the seat body 1 to the seat base 2 at various heights or to engage additional stop pieces 321. In other embodiments, the positioning holes 314 may be replaced or combined with protrusions that are formed on the support structure 31 and that engage corresponding protrusions or holes formed on the latching components 32.

Each of the support structures 31 is slidably received within a corresponding receiving slot 221 formed within one of the support structure housings 22 that extend from the bottom plate 21 of the seat base 2. The support structures 31 and the support structure housings 22 may cooperate to guide the vertical motion of the seat base 2 and the seat body 1 relative to each other.

As shown in FIGS. 4, 5, and 7 to 10, the height-adjustment mechanism 3 includes a pair of the latching components 32 coupled movably to the seat base 2. FIGS. 4 and 5 illustrate the coupling of the latching components 32 to the seat base 2, while FIGS. 7 to 10 illustrate the operation of the latching components 32 for adjusting a height of the child booster seat 100. Each of the latching components 32 includes the stop piece 321, a stop mounting part 324 connected to and supporting the stop piece 321, a slidable coupling part 323 attached to the stop mounting part 324, and a manually operable part 326 connected to the slidable coupling part 323. The height-adjustment mechanism 3 also includes a pair of the first biasing members 33 for biasing the stop piece 321 of a corresponding latching component 32 toward a corresponding positioning hole 314.

In the preferred embodiment, the stop piece 321, the stop mounting part 324, the slidable coupling part 323 and the manually operable part 326 are fixed together and are co-movable with each other. In other embodiments, the movement of the slidable coupling part 323 may cause a linked movement of the stop piece 321. The slidable coupling part 323 and the stop mounting part 324 are non-planar, and the stop piece 321 is connected to the stop mounting part 324 above the slidable coupling part 323.

Each of the stop pieces 321 may engage a selected one of the positioning holes 314 in a corresponding support structure 31 to releasably lock the seat body 1 at a desired height relative to the seat base 2. The manually operable part 326 can be pulled to move an associated stop piece 321 away from a corresponding positioning hole 314 to release a locking engagement between the seat base 2 and the seat body 1. Once the locking engagement has been released, the manually operable parts 326 may be pulled to extend the seat base 2 away from the seat body 1, thus raising the height of the seat body 1.

In the preferred embodiment, the stop mounting part 324 is a vertically oriented plate and the slidable coupling part 323 is a horizontally oriented plate, and the stop mounting part 324 and the slidable coupling part 323 may be connected to form an L-shaped bent plate 322. The stop mounting part 324 extends upward from the slidable coupling part 323 at an approximately right angle from a side of the slidable coupling part 323 that is proximate to the corresponding support structure 31.

In variations of the preferred embodiment, the stop mounting part 324 or the slidable coupling part 323 may include a frame, a rod, a post, or other similar structures. The stop mounting part 324 and the slidable coupling part 323 may be connected at any angle or coupled through a linkage, belt, string, wire, or other mechanism. The stop mounting part 324 may be slidably held in a channel formed in a corresponding support structure housing 22.

As shown in FIG. 5, the slidable coupling part 323 is formed with a pair of elongated guide holes 325 that extend between a corresponding manually operable part 326 and a corresponding support structure 31. Each elongated guide hole 325 allows one or more corresponding fastening components 211 that extend from the bottom plate 21 of the seat base 2 to protrude through the slidable coupling part 323. The fastening components 211 are each formed with a pair of engaging hooks 212 that hold the slidable coupling part 323 in proximity to the seat base 2. Each engaging hook 212 includes a hook part 213 that abuts against a side of a corresponding slidable coupling part 323 to prevent movement of the corresponding slidable coupling part 323 away from the bottom plate 21 of the seat base 2.

The fastening components 211 substantially restrict the corresponding slidable coupling part 323 and latching component 32 to movement parallel to the bottom plate 21 of the seat base 2 within a distance defined by the elongated guide hole 325. The latching components 32 are thus slidably coupled to a side of the bottom plate 21 from which the support structure housings 22 extend. In variations of the preferred embodiment, one rather than two elongated guide holes 325 may be formed in each slidable coupling part 323.

Each of the slidable coupling parts 323 is formed with a spring channel 328 that extends between a corresponding manually operable part 326 and a corresponding support structure 31. A spring mount 327 is formed at an end of each spring channel 328 on a side of the corresponding stop mounting part 324. Each of a pair of spring blocks 215 extends from the bottom plate 21 through the spring channel 328 of a corresponding slidable coupling part 323. Each first biasing member 33 of the height-adjustment mechanism 3 is a linear spring mounted between a corresponding spring mount 327 and a corresponding spring block 215, or in other words, between a corresponding latching component 32 and the bottom plate 21. Each first biasing member 33 is mounted in a plane substantially parallel to the bottom plate 21. Each first biasing member 33 may include a torsion or a linear spring that resists a tensile or compression force.

The manually operable parts 326 are accessible through the through hole 214 in the seat base 2 and may include handles, rings, levers, ridges, buttons, dials, or other devices that receive a pushing, pulling, rotating, or other input motion or force. Two of the manually operable parts 326 may be pulled together using one hand. In another embodiment, one manually operable part 326 may operate two or more stop pieces 321, which may engage positioning holes 314 in the same or different support structures 31.

As shown in FIGS. 7 to 10, the manually operable parts 326 are configured for: a) releasing locking engagement between the seat base 2 and the seat body 1; and b) for exerting a pulling force for pulling the seat base 2 to move vertically relative to the seat body 1 to adjust the height of the seat body 1 relative to the seat base 2 when the locking engagement between the seat base 2 and the seat body 1 is released.

Figure 7:
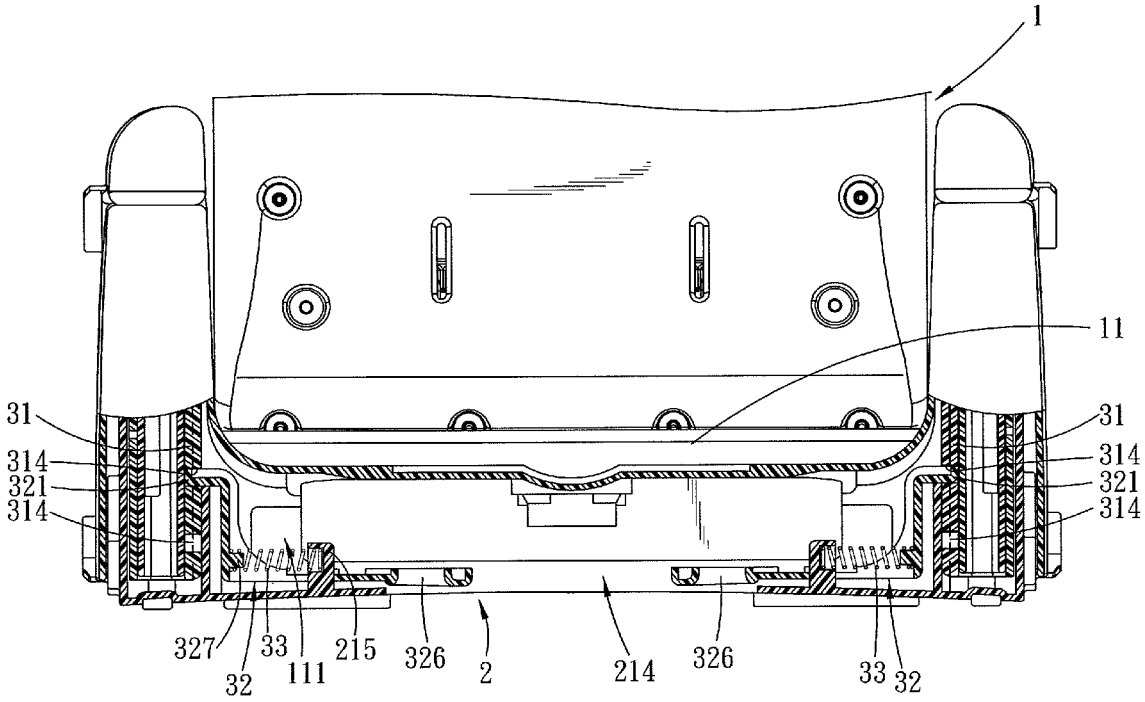
FIG. 7 is a schematic sectional view illustrating the seat body in a lowered position with engaged latching components, according to the preferred embodiment.

When the manually operable parts 326 are released, the first biasing members 33 bias the stop pieces 321 towards respective positioning holes 314. In FIG. 7, the stop pieces 321 are engaged with an upper set of positioning holes 314, releasably locking the seat body 1 in a lowered height position relative to the seat base 2.

Figure 8:
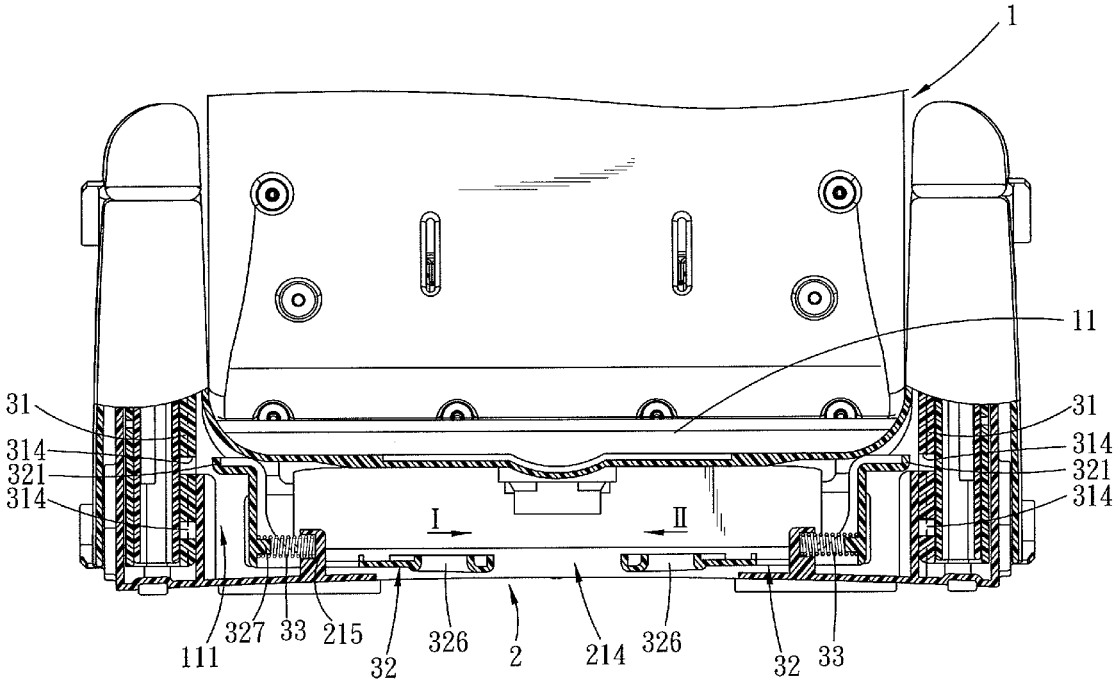
FIG. 8 is a schematic sectional view illustrating the seat body in a lowered position with disengaged latching components, according to the preferred embodiment.

In FIG. 8, when the height of the seat body 1 is to be adjusted, a user may access the manually operable parts 326 of the latching components 32 by extending one hand into the through hole 214. The user may then grasp both manually operable parts 326 with one hand and pull them towards each other simultaneously (e.g., in the directions I and II of FIG. 8). Pulling the manually operable parts 326 together compresses the first biasing members 33 between the spring blocks 215 and the latching components 32, and disengages the stop pieces 321 from the positioning holes 314.

Figure 9:
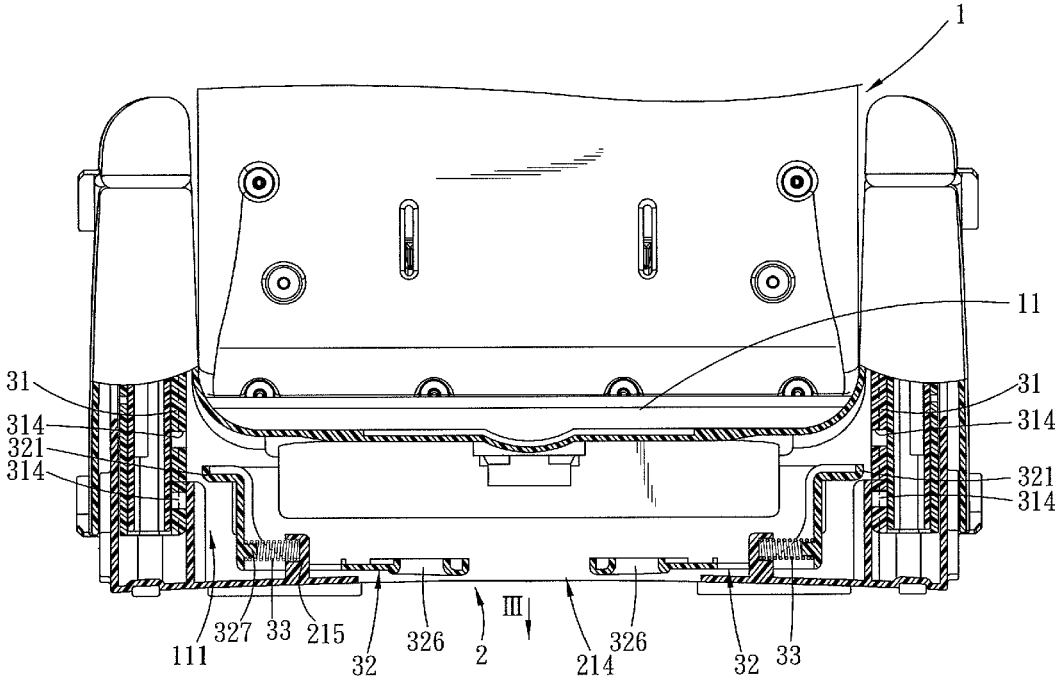
FIG. 9 is a schematic sectional view illustrating the seat body between a lowered position and a raised position with disengaged latching components that may be pulled for height expansion, according to the preferred embodiment.

As shown in FIG. 9, when the stop pieces 321 have been disengaged from the positioning holes 314, the manually operable parts 326 may be pulled in the direction III to extend the seat base 2 away from the seat body 1. In the extended position of the manually operable parts 326, the fastening components 211 of each of the latching components 32 may be abutted against an end of a respective elongated guide hole 325.

Figure 10:
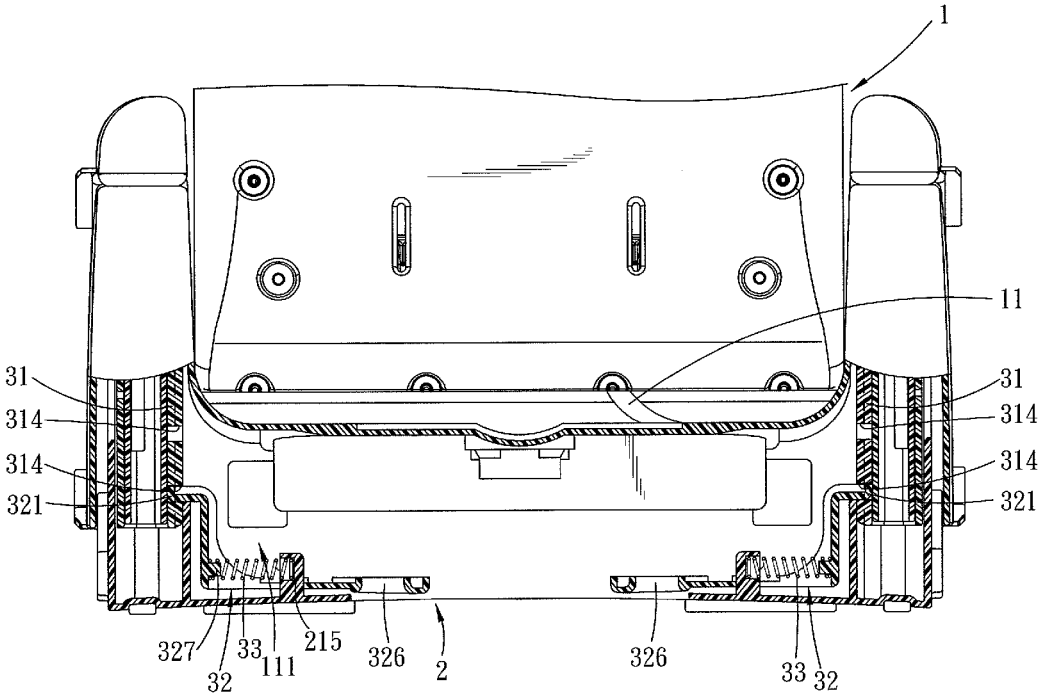
FIG. 10 is a schematic sectional view illustrating the seat body in a raised position with engaged latching components, according to the preferred embodiment.
Figure 11:
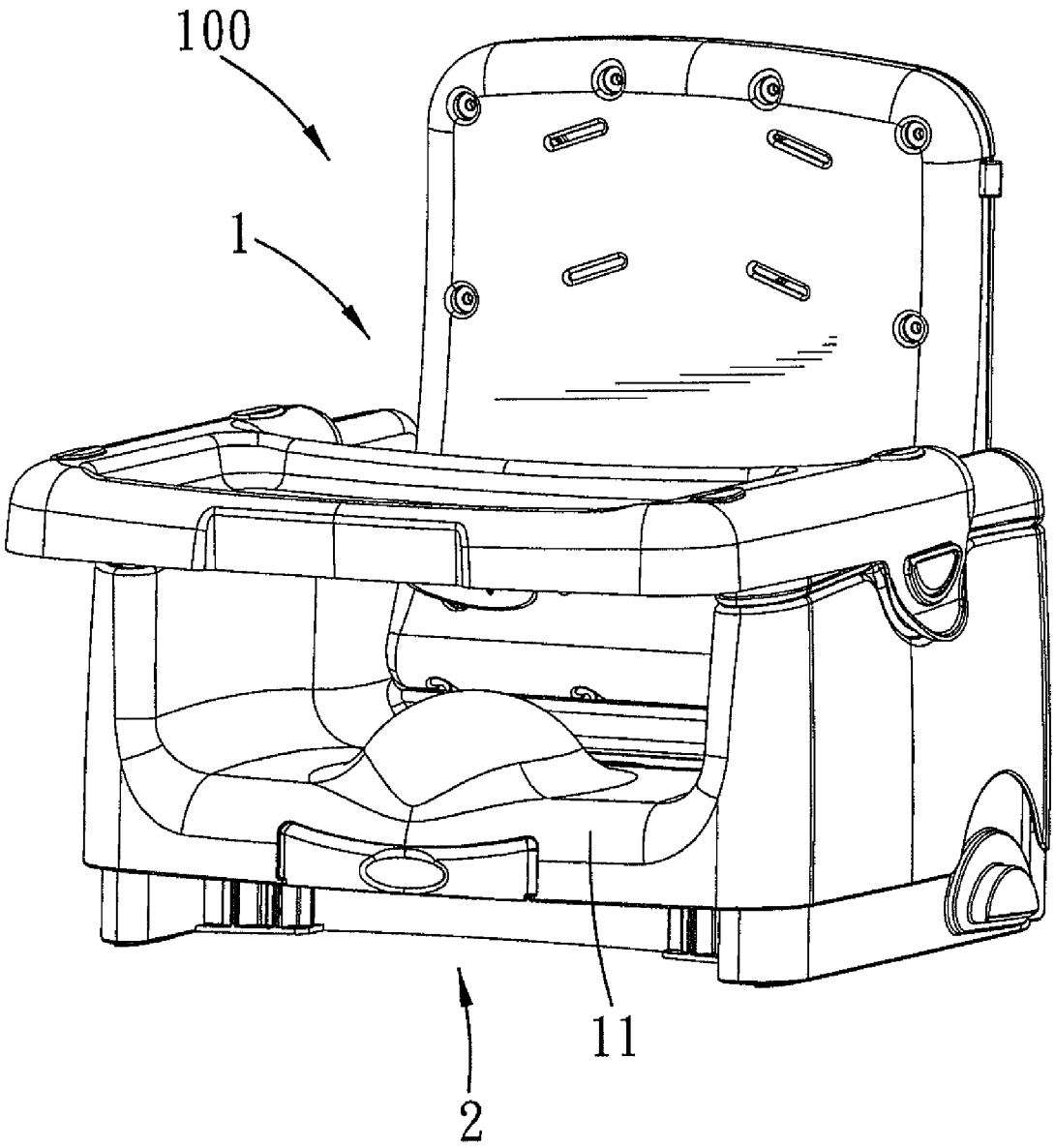
FIG. 11 is a perspective view illustrating the seat body in a raised position, according to the preferred embodiment.

As shown in FIG. 10, when the seat base 2 has been pulled in the direction III until the stop pieces 321 are aligned with a lower set of the positioning holes 314, the manually operable parts 326 may be released. The first biasing members 33 may then move the stop pieces 321 back towards the positioning holes 314 automatically. A perspective view of the extended position of the child booster seat 100 is illustrated in FIG. 11.

As shown in FIG. 6, in the preferred embodiment, the height-adjustment mechanism 3 includes three second biasing members 35 mounted between the seat base 2 and the seat body 1 for biasing the seat base 2 away from the seat body 1. Each of the second biasing members 35 is a compression spring sleeved on one of three expansion columns 116 that protrude downward from the bottom side of the support casing 11 of the seat body 1. For each expansion column 116, a corresponding post housing 24 extends upward from the bottom plate 21, as shown in FIG. 5. Each post housing 24 is formed with an expansion hole 241 that slidably receives the corresponding expansion column 116 and the second biasing member 35 sleeved on the corresponding expansion column 116.

Each of the second biasing members 35 biases the seat base 2 away from the support casing 11 of the seat body 1. When the user adjusts the seat base 2 in the downward direction, the second biasing members 35 assist the user in pulling the seat base 2 away from the seat body 1.

As shown in FIGS. 2, 5, and 6, three anchor parts 114, each formed with a threaded hole 115, extend downward from the support casing 11 of the seat body 1. Three posts 23, each of which is registered with a corresponding anchor part 114, extend upward from the seat base 2. Each of the posts 23 is formed with a post hole 231 and a stop shoulder 232 that protrudes into the post hole 231.

As shown in FIG. 6, the height-adjustment mechanism 3 includes multiple limit components 34. Each limit component 34 includes a threaded portion 341 at one end, a restriction flange 342 at the other end, and a slide rod portion 343 disposed between the threaded portion 341 and the restriction flange 342. Each limit component 34 is mounted to a corresponding anchor part 114 and extends into the post hole 231 of a corresponding post 23. The threaded portion 341 is screwed into the threaded hole 115 of the anchor part 114. The slide rod portion 343 of the limit component 34 extends past the stop shoulder 232 into the post hole 231 of the post 23 mounted to the seat base 2. The restriction flange 342 of the limit component 34 may abut against the stop shoulder 232 to prevent the seat base 2 from separating from the seat body 1. The slide rod portion 343 may guide a vertical movement of the seat base 2 relative to the seat body 1.

In a variation of the preferred embodiment, the anchor parts 114, each formed with a threaded hole 115, extend upward from the seat base 2. A plurality of posts 23, each of which is registered with a corresponding anchor part 114, extend downward from the support casing 11 of the seat body 1. Each of the posts 23 is formed with a post hole 231 and a stop shoulder 232 that protrudes into the post hole 231. Each limit component 34 is mounted to a corresponding anchor part 114 and extends into the post hole 231 of a corresponding post 23. Accordingly, in a variation of the preferred embodiment, each limit component 34 is mounted to the seat base 2 rather than the seat body 1, and the post 23 is included by the seat body 1 rather than the seat base 2. In other variations, the limit components 34 and the posts 23 may be mounted in different combinations to either the seat body 1 or the seat base 2.

In variations of the preferred embodiment, one rather than two of the support structures 31, the latching components 32, and the first biasing members 33 may be implemented to adjust the relative height between the seat body 1 and the seat base 2. Similarly, one rather than two or more of either the limit components 34 or the second biasing members 35 may be respectively used to either limit or assist with separation between the seat body 1 and the seat base 2.

To sum up, by engaging the stop pieces 321 of the latching components 32 with the positioning holes 314 of the support structures 31, the seat body 1 can be releasably locked to the seat base 2 at a desired height. The manually operable parts 326 may be pulled in a first direction to release locking engagement between the seat body 1 and the seat base 2 and pulled in a second direction to adjust the height of the seat body 1 relative to the seat base 2. The manually operable parts 326 may then be released to allow the first biasing members 33 to move the stop pieces 321 of the latching components 32 to engage the positioning holes 314 of the support structures 31 at a selected height.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A child booster seat, comprising:

a seat body;

a seat base coupled to and vertically movable relative to said seat body; and a height-adjustment mechanism mounted between said seat body and said seat base, said height-adjustment mechanism including a support structure mounted co-movably to said seat body and formed with a plurality of positioning holes that are vertically spaced apart, a latching component coupled movably to said seat base, said latching component including a stop piece for engaging a selected one of said positioning holes to releasably lock said seat body at a desired height relative to said seat base, and a manually operable part for moving said stop piece away from said positioning holes to release locking engagement between said seat base and said seat body, a first biasing member for biasing said stop piece toward said positioning holes, and a second biasing member mounted between said seat base and said seat body for biasing said seat base away from said seat body.

2. The child booster seat as claimed in claim 1, wherein said seat base includes a bottom plate and a support structure housing that protrudes from said bottom plate, said support structure housing being formed with a receiving slot, said support structure being slidably received within said receiving slot.

3. The child booster seat as claimed in claim 2, wherein said bottom plate of said seat base is formed with a through hole, said latching component being slidably coupled to a side of said bottom plate from which said support structure housing extends, said manually operable part being accessible through said through hole.

4. The child booster seat as claimed in claim 2, wherein said seat body includes a support casing formed with an accommodation space that opens downward, said support casing covering said seat base.

5. The child booster seat as claimed in claim 2, wherein said latching component includes a stop mounting part and a slidable coupling part that are connected to each other and that are non-planar, said stop piece being connected to said stop mounting part above said slidable coupling part, said manually operable part being connected to said slidable coupling part.

6. The child booster seat as claimed in claim 5, wherein said bottom plate of said seat base includes a fastening component, said slidable coupling part of said latching component being formed with an elongated guide hole for said fastening component to extend through and for substantially restricting said latching component to movement parallel to said bottom plate within a distance defined by said elongated guide hole.

7. The child booster seat as claimed in claim 6, wherein said first biasing member is a linear spring mounted between said latching component and said bottom plate in a plane substantially parallel to said bottom plate.

8. The child booster seat as claimed in claim 6, wherein:

one of said seat body and said seat base includes a post formed with a post hole and a stop shoulder that projects into said post hole; and said height-adjustment mechanism further includes a limit component mounted to the other one of said seat body and said seat base, said limit component extending through said post hole of said post, said limit component having a restriction flange for abutting against said stop shoulder to prevent said seat base from separating from said seat body.

9. The child booster seat as claimed in claim 8, wherein said limit component includes a threaded portion for mounting said limit component to the other one of said seat body and said seat base, and a slide rod portion extending between said threaded portion and said restriction flange for guiding vertical movement of said seat body with respect to said seat base.

10. The child booster seat as claimed in claim 1, wherein said manually operable part of said latching component is configured for exerting a pulling force for pulling said seat base to move vertically relative to said seat body to adjust the height of said seat body relative to said seat base when the locking engagement between said seat base and said seat body is released.

11. A height-adjustment mechanism for a child booster seat, the child booster seat including a seat body and a seat base coupled to and vertically movable relative to the seat body, said height-adjustment mechanism comprising:

a support structure adapted for mounting co-movably to the seat body and formed with a plurality of positioning holes that are vertically spaced apart;

a latching component adapted for coupling movably to the seat base, said latching component including a stop piece for engaging a selected one of the positioning holes to releasably lock the seat body at a desired height relative to the seat base, and a manually operable part for moving said stop piece away from the positioning holes to release locking engagement between the seat base and the seat body;

a first biasing member for biasing said stop piece toward the positioning holes, and a second biasing member adapted for biasing the seat base away from the seat body.

12. The height-adjustment mechanism for a child booster seat as claimed in claim 11, the seat base including a bottom plate and a support structure housing that protrudes from the bottom plate, the support structure housing being formed with a receiving slot, the support structure being slidably received within the receiving slot, the bottom plate of the seat base being formed with a through hole, wherein said latching component is adapted for coupling slidably to a side of the bottom plate from which the support structure housing extends such that said manually operable part is accessible through the through hole.

13. The height-adjustment mechanism for a child booster seat as claimed in claim 11, the seat base including a bottom plate and a support structure housing that protrudes from the bottom plate, the support structure housing being formed with a receiving slot, the support structure being slidably received within the receiving slot, wherein said latching component includes a stop mounting part and a slidable coupling part that are connected to each other and that are non-planar, said stop piece being connected to said stop mounting part above said slidable coupling part, said manually operable part being connected to said slidable coupling part.

14. The height-adjustment mechanism for a child booster seat as claimed in claim 13, further comprising a fastening component adapted to be provided on the bottom plate of the seat base, said slidable coupling part of said latching component being formed with an elongated guide hole for said fastening component to extend through and for substantially restricting said latching component to movement parallel to the bottom plate within a distance defined by said elongated guide hole.

15. The height-adjustment mechanism for a child booster seat as claimed in claim 14, wherein said first biasing member is a linear spring adapted for mounting between said latching component and the bottom plate in a plane substantially parallel to the bottom plate.

16. The height-adjustment mechanism for a child booster seat as claimed in claim 14, further comprising:

a post adapted to be provided on one of the seat body and the seat base and formed with a post hole and a stop shoulder that projects into said post hole; and a limit component adapted to be mounted to the other one of the seat body and the seat base, said limit component extending through said post hole of said post, and having a restriction flange for abutting against said stop shoulder to prevent the seat base from separating from the seat body.

17. The height-adjustment mechanism for a child booster seat as claimed in claim 16, wherein said limit component includes a threaded portion adapted for mounting said limit component to the other one of the seat body and the seat base, and a slide rod portion extending between said threaded portion and said restriction flange for guiding vertical movement of the seat body with respect to the seat base.

18. The height-adjustment mechanism for a child booster seat as claimed in claim 11, wherein said manually operable part of said latching component is configured for exerting a pulling force for pulling the seat base to move vertically relative to the seat body to adjust the height of the seat body relative to the seat base when the locking engagement between the seat base and the seat body is released.

* * * * *